US007503264B2

(12) United States Patent
Mitchell et al.

(10) Patent No.: US 7,503,264 B2
(45) Date of Patent: Mar. 17, 2009

(54) CONSTANT CONTACT SIDE BEARING ASSEMBLY

(75) Inventors: Nathaniel L. Mitchell, Ypsilanti, MI (US); Anand G. Huprikar, Novi, MI (US); Terrence A. Bell, Grove City, PA (US)

(73) Assignee: BASF Corporation, Florham Park, NJ (US)

( * ) Notice: Subject to any disclaimer, the term of this patent is extended or adjusted under 35 U.S.C. 154(b) by 147 days.

(21) Appl. No.: 11/560,478

(22) Filed: Nov. 16, 2006

(65) Prior Publication Data

US 2008/0115690 A1 May 22, 2008

(51) Int. Cl.
*B61F 3/00* (2006.01)
*B61F 1/00* (2006.01)

(52) U.S. Cl. ..... 105/199.3; 105/453

(58) Field of Classification Search ..... 105/199.3, 105/199.4, 453

See application file for complete search history.

(56) References Cited

U.S. PATENT DOCUMENTS

| | | | | |
|---|---|---|---|---|
| 2,698,208 | A | 12/1954 | Dilg | |
| 3,712,691 | A | 1/1973 | Cope | |
| 3,719,154 | A | 3/1973 | Reynolds | |
| 3,735,711 | A | 5/1973 | Hassenauer | |
| 3,910,655 | A | 10/1975 | Willison et al. | |
| 4,567,833 | A | 2/1986 | Hanson | |
| 4,712,487 | A | 12/1987 | Carlson | |
| 5,386,783 | A | 2/1995 | Rhen et al. | |
| 5,454,330 | A | 10/1995 | Rhen | |
| 5,601,031 | A | 2/1997 | Carlson | |
| 5,682,822 | A | 11/1997 | Sunderman et al. | |
| 6,092,470 | A | 7/2000 | O'Donnell | |
| 6,141,853 | A | 11/2000 | O'Donnell | |
| 6,341,422 | B1 | 1/2002 | O'Donnell | |
| 6,708,624 | B2 | 3/2004 | Faryniak et al. | |
| 6,862,999 | B2 | 3/2005 | O'Donnell et al. | |
| 6,957,611 | B2 | 10/2005 | O'Donnell et al. | |
| 7,121,212 | B2 * | 10/2006 | Schorr et al. | 105/199.3 |
| 2004/0187726 | A1 * | 9/2004 | Schorr et al. | 105/199.3 |
| 2005/0087092 | A1 * | 4/2005 | McKisic et al. | 105/199.3 |
| 2005/0183626 | A1 | 8/2005 | O'Donnell et al. | |
| 2005/0223935 | A1 | 10/2005 | Jensen et al. | |
| 2005/0279245 | A1 | 12/2005 | O'Donnell et al. | |
| 2006/0042498 | A1 * | 3/2006 | Schorr et al. | 105/199.3 |
| 2008/0035012 | A1 * | 2/2008 | Monaco et al. | 105/199.3 |
| 2008/0035013 | A1 * | 2/2008 | Johnstone et al. | 105/199.3 |
| 2008/0115690 | A1 * | 5/2008 | Mitchell et al. | 105/199.3 |

* cited by examiner

*Primary Examiner*—S. Joseph Morano
*Assistant Examiner*—Jason C Smith
(74) *Attorney, Agent, or Firm*—Howard & Howard

(57) ABSTRACT

A side bearing assembly for a railway vehicle includes a cage, a cap coupled to and moveable relative to the cage, and an insulator disposed between the cage and the cap. The railway vehicle includes a bolster extending laterally and a car body disposed on the bolster. The cage is attached to the bolster and the cap supports a portion of the car body such that the side bearing assembly is disposed between the bolster and the car body to dampen lateral pivoting of the car body relative to the bolster. The insulator is formed of microcellular polyurethane for resiliently deforming and storing energy during compressive movement between the car body and the bolster through a range of temperatures between −40° C. and 80 ° C. Microcellular polyurethane maintains flexibility at this temperature range such that the side bearing assembly maintains its ability to dampen lateral pivoting through this temperature range.

19 Claims, 3 Drawing Sheets

CONSTANT CONTACT SIDE BEARING ASSEMBLY

BACKGROUND OF THE INVENTION

1. Field of the Invention

The present invention relates to a side bearing assembly for a vehicle. Specifically, the invention relates to a side bearing assembly including an insulator for storing energy when the insulator is subjected to compressive forces.

2. Description of the Related Art

Side bearing assemblies for railway vehicles are known in the art. Generally, railway vehicles include a truck, i.e., a wheel assembly, and a car body disposed on the truck. For example, the car body could be a tanker. The truck includes a plurality of bolsters extending transversely across the truck. Each bolster of the truck includes a center bowl and the car body includes a body center plate corresponding to each center bowl. One of a pair of side bearing assemblies is attached to the bolster on either side of the center bowl. Each center bowl pivotally receives the corresponding body center plate such that the car body is laterally pivotal relative to the truck in the center bowl. The car body is supported by the center bowl and each of the pair of side bearing assemblies. The side bearing assemblies are often referred to as constant contact side bearing assemblies because each of the pair of side bearing assemblies remains in constant contact with the car body of the railway vehicle. If contact between the car body and the side bearing is interrupted, the car body may slide relative to the bolster, which increases the potential for derailment.

The truck includes wheels that ride on tracks. Due to the shape of the wheels and the shape of the tracks, when the railway vehicle moves along a straight section of the track, the wheels are constantly hunting, i.e. searching, for a centered position on the track. Due to the hunting, the truck of the railway vehicle will oscillate relative to the track. As the truck oscillates relative to the track, the car body laterally pivots on the center bowl. As the car body laterally pivots, the car body makes a compressive movement to compress one of the side bearing assemblies of the pair of side bearing assemblies while simultaneously making a decompressive movement to decompress the other side bearing assembly of the pair of side bearing assemblies. The oscillation of the truck relative to the track increases as the speed of the railway vehicle increases, which increases the lateral pivoting of the car body relative to the truck. At high speeds, forces generated by the oscillation of the truck and forces generated by the car body laterally pivoting relative to the truck can cause the wheels to climb off the track resulting in derailment of the railway vehicle.

The side bearing assemblies dampen the lateral pivoting of the car body relative to the truck. The lateral pivoting of the car body repeatedly loads compressive forces on the cap and unloads the compressive forces from the cap. When the car body loads compressive forces on the cap, the insulator is compressed between the cap and the cage. When the car body unloads force from the cap, the insulator decompresses and delivers the energy back to the cap to urge the cap upwardly and to keep the cap in constant contact with the car body. In other words, the insulator is constantly urging the cap upwardly to maintain contact between the cap and the car body. Because an increase in the speed of the railway vehicle results in an increase in pivoting of the car body relative to the truck, the increase in speed of the railway vehicle increases the lateral pivoting of the car body. Therefore, the speed of the railway vehicle is limited by the ability of the side bearing assembly to dampen the pivoting of the car body relative to the bolster.

For example, a side bearing assembly is disclosed in U.S. Pat. No. 3,712,691 to Cope (the '691 patent). Specifically, the '691 patent discloses the side bearing assembly including a cage for attachment to the bolster, a cap disposed over the cage, and an insulator disposed between the cap and the cage. The cap contacts and supports a portion of the car body and is moveable relative to the cage. The insulator of the '691 patent is made from a rubbery material.

On occasion railway vehicles are operated in relatively cold temperatures. When the insulator is subjected to relatively cold temperatures, the flexibility of the insulator is decreased. In other words, in relatively cold temperatures the insulators are significantly less compressible. Accordingly, cold temperatures decrease the ability of the insulator, such as the insulator in the '691 patent, to dampen the lateral pivoting of the car body relative to the truck. Because the speed of the railway vehicle is limited by the dampening capability of the side bearing assembly, when the dampening capability is decreased at relatively cold temperatures, the speed of the railway vehicle must also be decreased. It is desirable to manufacture a side bearing assembly including an insulator that maintains flexibility at relatively cold temperatures.

In addition, the current insulators have a relatively small compression travel, i.e. the difference between the height of the uncompressed insulator and the height of the compressed insulator. When subject to compressive movement of the car body, the insulator is compressed and the height of the insulator is decreased. When subject to decompressive movement of the car body, the insulator decompresses and retains its height. When subject to decompressive movement, the insulator must decompress and exert force on the cap such that the cap remains in constant contact with the car body. If the compression travel is insufficient such that the insulator does not exert sufficient force on the cap, then the contact between the cap and the car body is interrupted, which can lead to movement of the car body relative to the bolster and increase the potential of derailment. Because increased speed of the railway vehicle increases the pivoting of the car body relative to the bolster, the speed of the railway vehicle is limited by the compression travel of the insulator. Current insulators are too rigid and too incompressible such that the compression travel of the insulators is insufficient to maintain constant contact at higher speeds. It is desirable to manufacture a side bearing assembly including an insulator with improved compression travel such that the insulator exhibits more compression travel and absorbs larger forces produced by increased pivoting of the car body relative to the truck at high speeds.

SUMMARY OF THE INVENTION AND ADVANTAGES

The present invention is a side bearing assembly for a railway vehicle including a bolster and a car body disposed on the bolster. The side bearing assembly includes a cage for attachment to the bolster, a cap coupled to the cage and moveable relative to the cage for supporting a portion of the car body of the railway vehicle, and an insulator disposed between the cap and the cage for coupling the cap to the cage. The insulator is formed of microcellular polyurethane for resiliently deforming and storing energy during compressive movement between the car body and the bolster through a range of temperatures between −40° C. and 80° C.

Accordingly, because the insulator is formed of microcellular polyurethane, the flexibility of the insulator is minimally affected by relatively cold temperatures, such as temperatures between −40° C. and 0° C. Because flexibility is minimally affected, the ability to dampen lateral pivoting of the car body relative to the bolster is also minimally affected and the maximum speed of the railway vehicle is minimally affected by the relatively cold temperatures. In addition, the insulator formed of microcellular polyurethane exhibits more compression travel than do current insulators formed of different materials. The increased compression travel enables the railway vehicle to travel at a higher speed while maintaining the cap in constant contact with the car body to avoid derailment.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
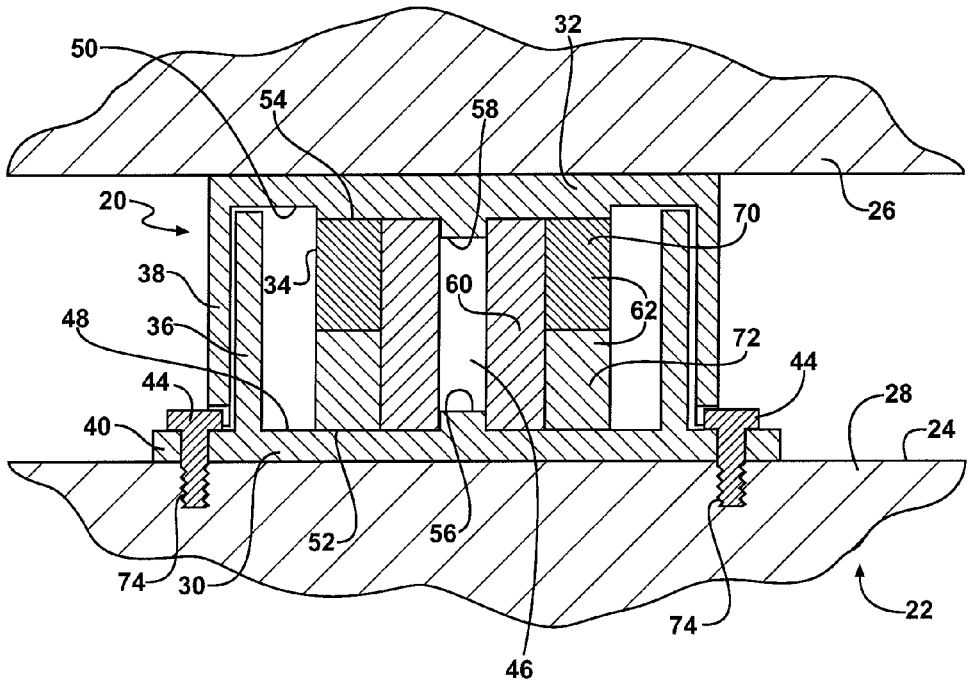
FIG. 1 is a partial cross-sectional view of a bolster, a car body, and a side bearing assembly disposed between the bolster and the car body.
Figure 3:
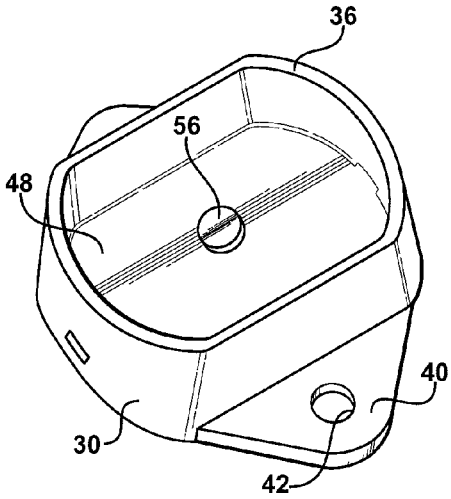
FIG. 3 is a perspective view of the cage including a base and a cage projection extending from the base.

Referring to the Figures, wherein like numerals indicate corresponding parts throughout the several views, a side bearing assembly 20 for a railway vehicle 22 is generally shown. The railway vehicle 22 includes a truck 24, i.e. a wheel assembly, and a car body 26 disposed on the truck 24. Specifically, the truck 24 of the railway vehicle 22 includes a plurality of bolsters 28 extending transversely across the truck 24. Each bolster 28 includes a center bowl. One of a pair of side bearing assemblies is attached to the bolster 28 on either side of the center bowl. The car body 26 is pivotally received by the center bowl and is supported by the center bowl and by each side bearing assembly 20.

As the railway vehicle 22 travels along a track, the truck 24 of the railway vehicle 22 is constantly hunting, i.e. searching, for a central position on the track. The hunting causes the truck 24 to oscillate relative to the track while traveling along the track. As the truck 24 oscillates relative to the track, the car body 26 laterally pivots on the center bowl. As the car body 26 laterally pivots, the car body 26 makes a compressive movement to compress one of the pair of side bearing assemblies while simultaneously making a decompressive movement to decompress the other of the pair of said bearing assemblies.

Referring to FIG. 1, each side bearing assembly 20 includes a cage 30, a cap 32 coupled to the cage 30, and an insulator 34 disposed between the cage 30 and the cap 32. Specifically, the cage 30 is attached to the bolster 28 of the railway vehicle 22. The cap 32 supports a portion of the car body 26 of the railway vehicle 22 and is moveable relative to the cage 30. The insulator 34 couples the cap 32 to the cage 30.

The insulator 34 provides a spring force acting against the cap 32 in a direction toward the car body 26 to maintain contact between the cap 32 and the car body 26. Specifically, the car body 26 rests on the cap 32 and the insulator 34 provides the spring force acting against the cap 32 in a direction toward the car body 26 to increase friction between the car body 26 and the cap 32. Friction between the car body 26 and the cap 32 maintains the car body 26 in position relative to the truck 24. Preferably, the insulator 34 provides the spring force acting against the cap 32 at all times to maintain friction between the car body and the cap 32 at all times.

The side bearing assemblies 20 dampen the lateral pivoting of the car body 26 relative to the truck 24. The lateral pivoting of the car body 26 repeatedly loads compressive forces on the cap 32 during compressive movement and unloads the compressive forces from the cap 32 during decompressive movement. When the car body 26 loads forces on the cap 32, the insulator 34 is compressed between the cap 32 and the cage 30. Specifically, the insulator 34 resiliently deforms and stores energy during the compressive movement between the car body 26 and the bolster 28. During the decompressive movement, the insulator 34 regains its form and provides the spring force acting against 34 the cap 32 toward the car body 26 to keep the cap 32 in constant contact with the car body 26. In other words, the insulator 34 is constantly urging the cap 32 toward the car body 26 to maintain contact between the cap 32 and the car body 26.

The insulator 34 is formed of microcellular polyurethane (MCU) for resiliently deforming and storing energy during compressive movement between the car body 26 and the bolster 28 through a range of temperatures between −40° C. and 80° C. In other words, the MCU maintains much of its flexibility and compressibility, and thereby maintains the insulator maintains its ability store energy during compressive movement of the car body 26 and to deliver energy to the cap 32 during decompressive movement of the car body 26. The storing and delivering of energy by the insulator dampens the pivoting of the car body 26 relative to the bolster 28 through the range of temperatures between −40° C. and 80° C.

Specifically, the MCU maintains much of its ability to compress and decompress when subjected to compressive loads at low temperatures such as −40° C. to 0° C. For example, MCU experiences a 9% reduction in flexibility at a temperature of −25° C. compared to the flexibility of the MCU at 25° C. Such a reduction in flexibility is less than that of materials of prior art side bearing assemblies. Materials used in the prior art experience a greater decrease in flexibility and compressibility in cold temperature thereby decreasing the ability to dampen the pivoting of the car body 26 relative to the bolster 28. In other words, at low temperatures such as −40° C. to 0° C. the materials of the prior art insulators have a decreased ability to store energy during compressive movement of the car body and to deliver energy to the cap during decompressive movement. As such, the ability of the prior art insulator to dampen the pivoting of the car body relative to the bolster is decreased.

The ability of the side bearing assembly 20 to dampen the lateral pivoting of the car body 26 affects the maximum speed of the railway vehicle 22. Specifically, the oscillation of the truck 24 relative to the track increases as the speed of the railway vehicle 22 increases, which consequently increases the lateral pivoting of the car body 26 relative to the truck 24. At high speeds, forces generated by the oscillation of the truck 24 and forces generated by the car body 26 laterally pivoting relative to the truck 24 can cause the wheels to climb off the track resulting in derailment of the railway vehicle 22. The insulator 34 dampens the lateral pivoting of the car body 26 relative to the truck 24. Therefore, the speed of the railway vehicle 22 is limited by the ability of the insulator 34 to dampen the lateral pivoting of the car body 26 relative to the bolster 28.

Because the insulator 34 formed of MCU maintains much of its ability to dampen the lateral pivoting at relatively cold temperatures, the speed of the railway vehicle 22 may be maintained at relatively cold temperatures, e.g. −40° C. to 0° C. On the other hand, because the insulators of the prior art experience a decrease in flexibility at relatively cold temperatures, e.g. −40° C. to 0° C., the railway vehicle 22 using the prior art insulators must decrease in speed in relatively cold temperatures to prevent derailment.

The insulator 34 formed of MCU exhibits superior dampening ability at high loads compared to insulators of the prior art. Specifically, when the car body 26 exerts a high load on the insulator 34, the insulator 34 formed of MCU is capable of further compression during further compressive movement by the car body 26. As such, while under the high load, the insulator 34 formed of MCU remains capable of further compression to store energy during compressive movement by the car body 26 and to deliver energy to the cap 32 during decompressive movement of the car body 26. As discussed above, this storing and delivering of energy maintains contact and friction between the car body 26 and the cap 32 to maintain the car body 26 in position relative to the truck 24. On the other hand, when the car body 26 exerts the high load on the insulator formed of materials of the prior art, the insulator is less capable of further compression during further compressive movement by the car body 26 than the insulator 34 formed of MCU. As such, under the high load, the insulator formed of material of the prior art is less capable of further storing and delivering of energy and is less capable of maintaining contact and friction between the car body 26 and the cap 32.

As discussed above, the speed of the railway vehicle 22 is limited by the ability of the insulator 34 to dampen the lateral pivoting of the car body 26 relative to the bolster 28. Because the insulator 34 exhibits superior dampening ability at high loads compared to insulators of the prior art, this superior dampening ability reduces the limitations on the maximum speed of the railway vehicle 22.

The compression travel of the insulator 34 formed of microcellular polyurethane is greater than the compression travel of insulators of the prior art. Compression travel is the difference between the height of the insulator 34 in an uncompressed state and the height of the insulator 34 at a fully compressed state. When subject to compressive movement of the car body 26, the insulator 34 is compressed and the height of the insulator 34 is decreased. When subject to decompressive movement of the car body 26, the insulator 34 decompresses and regains the pre-compression height. As discussed above, when subject to decompressive movement, the insulator 34 must decompress and exerts force on the cap 32 such that the cap 32 remains in constant contact with the car body 26. Because increased speed of the railway vehicle 22 increases the pivoting of the car body 26 relative to the bolster 28, the speed of the railway vehicle 22 is limited by the compression travel of the insulator 34. The increased compression travel enables the railway vehicle 22 to travel at a higher speed while maintaining the cap 32 in constant contact with the car body 26 to avoid derailment.

For example, the MCU is of the type manufactured by BASF Corporation under the tradename Cellasto®. The MCU is formed from a two-step process. In the first step of the process, an isocyanate prepolymer is formed by reacting a polyol and an isocyanate. The polyol is polyester, and alternatively is polyether. The isocyanate is monomeric methyldiphenyl diisocyanate, and alternatively is naphthalene diisocyanate. In the second step of the process, the isocyanate prepolymer reacts with water to generate carbon dioxide and the carbon dioxide forms the cells of the MCU.

For example, polyester polyols are produced from the reaction of a dicarboxylic acid and a glycol having at least one primary hydroxyl group. For example, dicarboxylic acids that are suitable for producing the polyester polyols are selected from the group of, but are not limited to, adipic acid, methyl adipic acid, succinic acid, suberic acid, sebacic acid, oxalic acid, glutaric acid, pimelic acid, azelaic acid, phthalic acid, terephthalic acid, isophthalic acid, and combinations thereof. For example, glycols that are suitable for producing the polyester polyols are selected from the group of, but are not limited to, ethylene glycol, butylene glycol, hexanediol, bis (hydroxymethylcyclohexane), 1,4-butanediol, diethylene glycol, 2,2-dimethyl propylene glycol, 1,3-propylene glycol, and combinations thereof. The polyester polyol has a hydroxyl number of from 30 to 130, a nominal functionality of from 1.9 to 2.3, and a nominal molecular weight of from 1000 to 3000. Specific examples of polyester polyols suitable for the subject invention include Pluracol® Series commercially available from BASF Corporation of Florham Park, N.J.

For example, polyether polyols are produced from the cyclic ether propylene oxide, and alternatively ethylene oxide or tetrahydrofuran. Propylene oxide is added to an initiator in the presence of a catalyst to produce the polyester polyol. Polyester polyols are selected from the group of, but are not limited to, polytetramethylene glycol, polyethylene glycol, polypropylene glycol, and combinations thereof. The polyether polyol has a hydroxyl number of from 30 to 130, a nominal functionality of from 1.9 to 2.3, and a nominal molecular weight of from 1000 to 5000. Specific examples of polyether polyols suitable for the subject invention include Pluracol® 858, Pluracol® 538, Pluracol® 220, Pluracol® TP Series, Pluracol® GP Series, and Pluracol® P Series commercially available from BASF Corporation of Florham Park, N.J.

For example, diisocyanates are selected from the group of, but are not limited to, 4,4'-diphenylmethane diisocyanate, 2,4'-diphenylmethane diisocyanate, ethylene diisocyanate, ethylidene diisocyanate, propylene diisocyanate, butylene diisocyanate, cyclopentylene-1,3-diisocyanate, cyclohexylene-1,4-diisocyanate, cyclohexylene-1,2-diisocyanate, 2,4-toluylene diisocyanate, 2,6-toluylene diisocyanate, 2,2-diphenylpropane-4,4'-diisocyanate, p-phenylene diisocyanate, m-phenylene diisocyanate, xylylene diisocyanate, 1,4-naphthylene diisocyanate, 1,5-naphthylene diisocyanate, diphenyl-4,4'-diisocyanate, azobenzene-4,4'-diisocyanate, diphenylsulfone-4,4'-diisocyanate, dichlorohexamethylene diisocyanate, tetramethylene diisocyanate, pentamethylene diisocyanate, hexamethylene diisocyanate, 1-chlorobenzene-2,4-diisocyanate, furfurylidene diisocyanate, and combinations thereof. Specific examples of diisocyanates suitable for the subject invention include Lupranate® 5143, Lupranate® MM103, and Lupranate® R2500U commercially available from BASF Corporation of Florham Park, N.J.

The monomeric methyldiphenyl diisocyanate is selected from the group of 4,4'-diphenylmethane diisocyanate, 2,4'- diphenylmethane diisocyanate, and combinations thereof. Specific examples of monomeric methyldiphenyl diisocyanates suitable for the subject invention include Lupranate® M and Lupranate® MS commercially available from BASF Corporation of Florham Park, N.J. The monomeric methyldiphenyl diisocyante may also be modified with carbonimide. Specific examples of carbonimide-modified monomeric methyldiphenyl diisocyante include Lupranate® 5143 and Lupranate® MM103 commercially available from BASF Corporation of Florham Park, N.J.

As known to one skilled in the art, MCU has a microcellular structure. In other words, the MCU presents cell walls defining cells, or void space. When not subject to compressive forces, the cell walls have an original shape and the cells are generally filled with air. Generally, when the insulator 34 made of MCU is subjected to compressive forces, the cell walls are collapsed and air evacuates from the cells and the insulator 34 is thereby deformed. When the compressive forces are removed from the insulator 34, the cell walls return to the pre-compression shape and the insulator 34 thereby regains its pre-compression form. Because the cell walls collapse when subject to compressive forces, the insulator 34 experiences minimal bulge when compressed.

Figure 4:
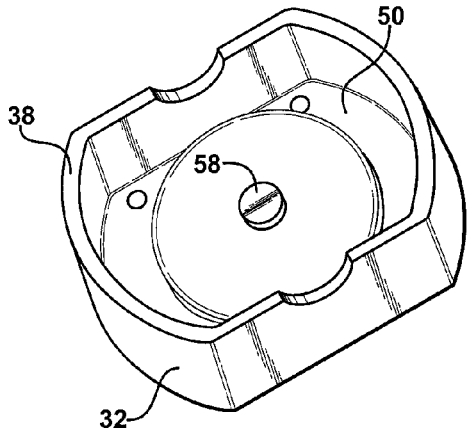
FIG. 4 is a perspective view of the cap including a plate and a cap projection extending from the plate.
Figure 2:
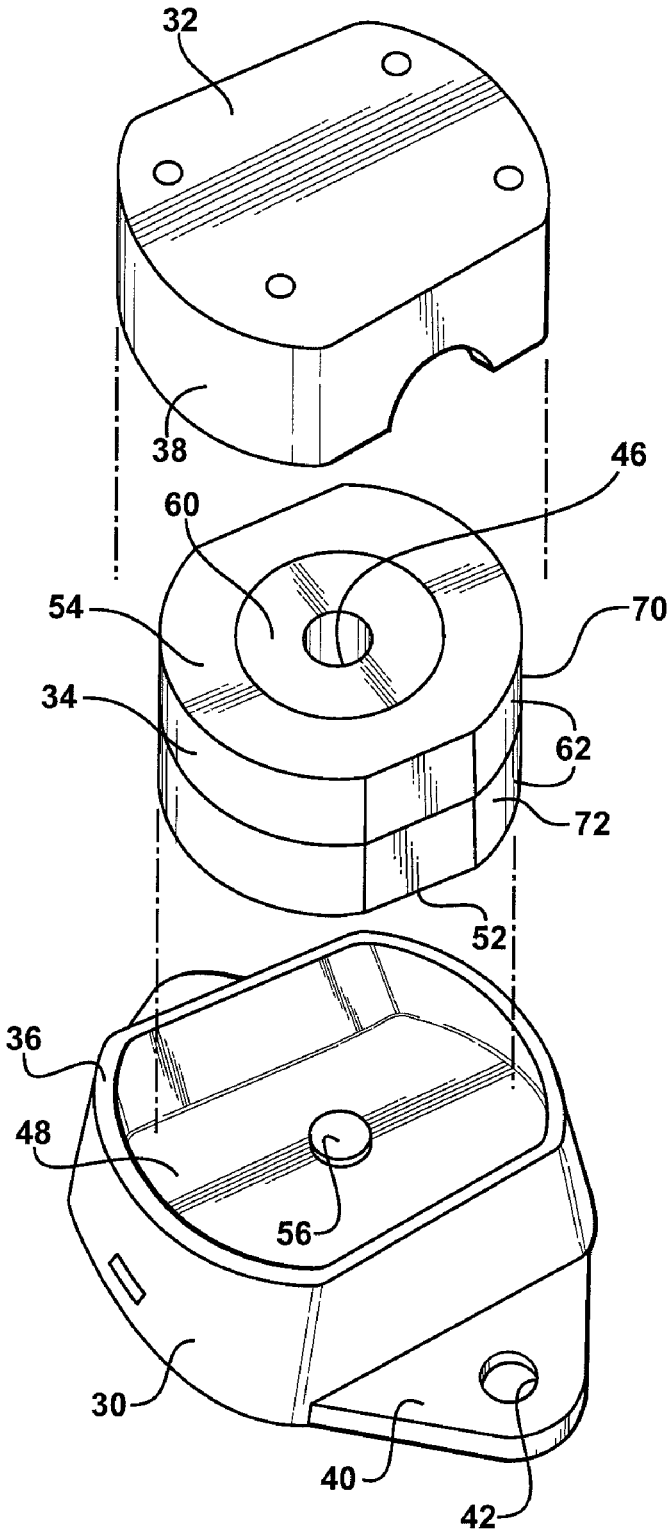
FIG. 2 is an exploded view of the side bearing assembly including a cage, a cap, and an insulator disposed between the cage and the cap.

As shown in FIG. 1, the cage 30 includes a flange 40 defining a fastening orifice 42 for receiving a fastener 44 through the fastening orifice 42 to fasten the cage 30 to the bolster 28 of the railway vehicle 22. Specifically, the cage 30 includes a pair of flanges 40 defining a pair of fastening orifices 42. Each fastening orifice 42 receives one of a pair of fasteners. The bolster 28 defines a pair of threaded orifices 74 and each fastening orifice 42 of the cage 30 is aligned with one of the pair of threaded orifices 74 in the bolster 28. The fastener 44 is threaded and extends through the fastening orifice 42 of the cage 30 and engages the threaded orifice 74 of the bolster 28 to attach the cage 30 to the bolster 28. As shown in FIGS. 2 and 4, the cap 32 defines cutouts to accommodate the threaded fasteners 44 when the cap 32 is coupled with the cage 30. The attachment of the cage 30 to the bolster 28 with threaded fasteners 44 through fastening orifice 42 is exemplary and it should be appreciated that the cage 30 may be attached to the bolster 28 in any fashion known to one skilled in the art.

As shown in FIGS. 1-2, the cage 30 includes a base 48 and an inner wall 36 extending from the base 48 toward the cap 32. The cap 32 includes a plate 50 and an outer wall 38 extending from the plate 50 toward the cage 30. The outer wall 38 of the cap 32 nests with the inner wall 36 of the cage 30 for coupling the cap 32 and the cage 30. The outer wall 38 of the cap 32 is moveable relative to the inner wall 36 of the cage 30 such that the cap 32 is moveable relative to the cage 30 during the compressive movement and the decompressive movement.

Figure 7:
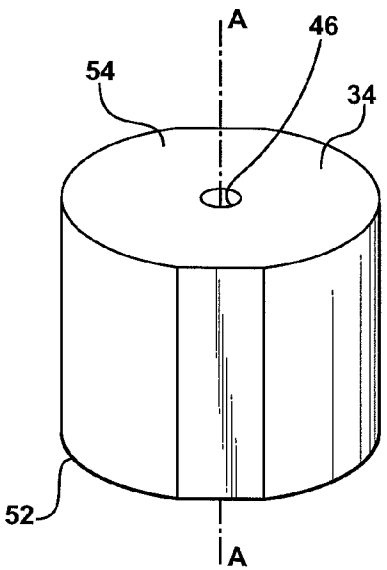
FIG. 7 is a perspective view of a third embodiment of the insulator wherein the insulator is a single continuous insulator.

As shown in FIGS. 1 and 2, the insulator 34 includes a bottom surface 52 being planar and adjacent the cage 30 and a top surface 54 being planar and adjacent the cap 32. The insulator 34 defines a hole 46 through the bottom surface 52 and through the top surface 54. As shown in FIG. 1, the hole 46 extends continuously through the insulator 34. It should be appreciated that the hole 46 need not be continuous through the insulator 34. For example, the hole 46 may be further defined as a first hole extending through the bottom surface 52 and partially into the insulator 34 and a second hole extending through the top surface 54 and partially into the insulator 34. It should also be appreciated that the first hole and the second hole need not be aligned with one another along a common axis. As shown in FIGS. 2 and 7-8, the insulator 34 has a shape defined by a pair of planar sides and a pair of semi-cylindrical sides extending between the pair of planar sides. It should be appreciated that the insulator 34 is not limited to this shape and may be any shape, such as, for example, a cylindrical shape.

As shown in FIGS. 1-2, the cage 30 presents a cage protrusion 56 extending from the base 48 toward the insulator 34. The cage protrusion 56 engages the hole 46 through the bottom surface 52 of the insulator 34 for maintaining the position of the insulator 34 relative to the cage 30. As shown in FIGS. 1 and 4, and the cap 32 presents a cap protrusion 58 extending from the plate 50 toward the insulator 34. The cap protrusion 58 engages the hole 46 through the top surface 54 of the insulator 34 for maintaining the position of the insulator 34 relative to the cap 32.

Figure 6:
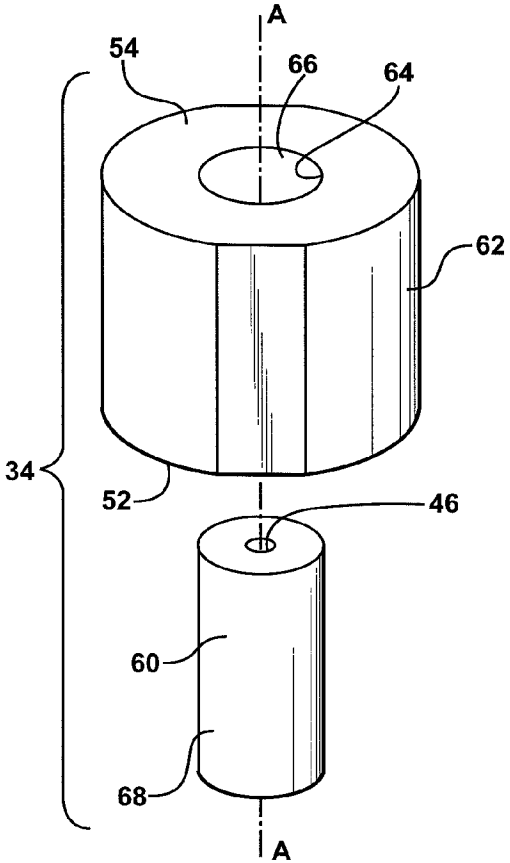
FIG. 6 is a perspective view of a second embodiment of the insulator including an interior member and an exterior member being a single continuous member.
Figure 5:
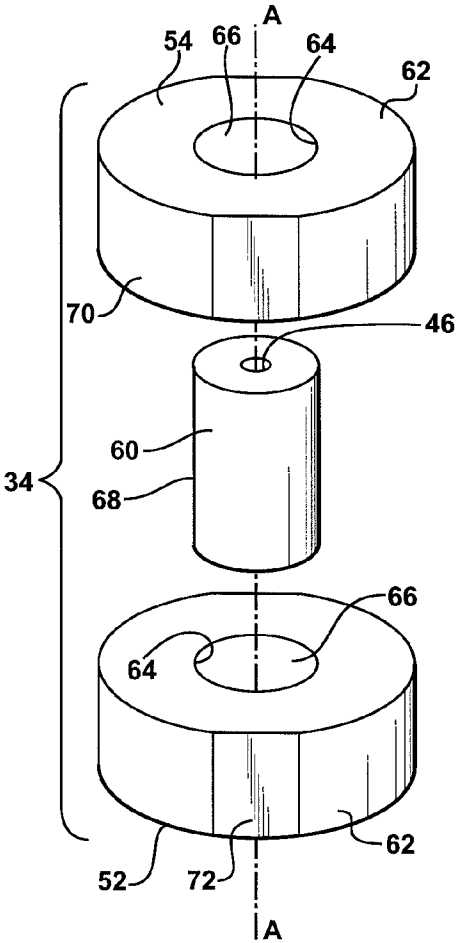
FIG. 5 is a perspective view of a first embodiment of the insulator including an interior member and an exterior member having a first and a second section.

A first embodiment of the insulator 34 is shown in FIGS. 1-2 and 5. A second embodiment of the insulator 34 is shown in FIG. 6. A third embodiment of the insulator 34 is shown in FIG. 7. In the first and second embodiment, the insulator 34 includes an interior member 60 and an exterior member 62. The interior member 60 extends along an axis A. The exterior member 62 includes an inner surface 64 defining a bore 66 extending through the exterior member 62 along the axis A. The exterior member 62 receives the interior member 60 in the bore 66.

In the first and second embodiment, both the interior member 60 and the exterior member 62 present the bottom surface 52 for disposition adjacent the cage 30 and the top surface 54 for disposition adjacent the cap 32. The interior member 60 presents an outer surface 68 extending along the axis A between the bottom surface 52 and the top surface 54 of the insulator 34 and corresponding in shape to the inner surface 64 of the exterior member 62. As shown in FIGS. 5-6, the outer surface 68 of the interior member 60 is cylindrical and the inner surface 64 of the exterior member 62 is cylindrical. It should be appreciated that the outer surface 68 of the interior member 60 and the inner surface 64 of the exterior member 62 are not limited to being cylindrical but may be any shape such that the outer surface 68 corresponds in shape to the inner surface 64.

In the first and second embodiment, the interior member 60 abuts the inner surface 64 of the exterior member 62 for maintaining the interior member 60 in the bore 66 of the exterior member 62. Preferably, the outer surface 68 of the interior member 60 and the inner surface 64 of the exterior member 62 are frictionally engaged. It should be appreciated that the interior member 60 and the exterior member 62 may be engaged in any fashion known in the art. For example, the interior member 60 and the exterior member 62 may be adhered to one another.

As shown in FIGS. 1-2 and 5, in the first embodiment of the insulator 34, the exterior member 62 includes a first section 70 extending along the axis A and a second section 72 extending along the axis A adjacent the first section 70. The first section 70 and the second section 72 abut each other and are optionally adhered to one another.

Depending upon manufacturing constraints, difficulties may arise in forming a relatively large insulator from MCU. These difficulties are addressed by the first embodiment by forming the insulator 34 from the interior member 60, the first section 70 of the exterior member 62, and the second section 72 of the exterior member 62. In other words, the interior member 60, the first section 70, and the second section 72, are formed more easily, in some circumstances, than a single continuous insulator 34.

In the first embodiment, both the interior member 60 and the exterior member 62 have a common density. Alternatively, the interior member 60 has a first density and the exterior member 62 has a second density different than the first density. The densities of the first and second sections 70, 72 may be common with or different than each other and may be common with or different than the density of the interior member 60, or any combination thereof. The densities of the interior member 60, the first section 70, and the second section 72 may be optimized as a design variable to optimize the dampening of the lateral pivoting of the car body 26 relative to the truck 24.

As shown in FIG. 6, in a second embodiment of the insulator 34, the exterior member 62 is a single continuous exterior member 62. As stated above, depending upon manufacturing constraints, difficulties may arise in forming a relatively large insulator from MCU. These difficulties are addressed in the second embodiment by forming the insulator 34 from the interior member 60 and the exterior member 62. In other words, depending upon the size of the insulator 34 the interior member 60 and the exterior member 62 are individually formed more easily than a single continuous insulator 34.

In the second embodiment, both the interior member 60 and the exterior member 62 have a common density. Alternatively, the interior member 60 has a first density and the exterior member 62 has a second density different than the first density. The densities of the interior member 60 and the exterior member 62 may be chosen as a design variable to optimize the dampening of the lateral pivoting of the car body 26 relative to the truck 24.

As shown in FIG. 7, in a third embodiment of the insulator 34, the insulator 34 is a single continuous insulator 34. It should be appreciated that the insulator 34 is not limited to the first, second, or third embodiment but instead may be any size, shape, or number of parts.

The invention has been described in an illustrative manner, and it is to be understood that the terminology which has been used is intended to be in the nature of words of description rather than of limitation. Obviously, many modifications and variations of the present invention are possible in light of the above teachings, and the invention may be practiced otherwise than as specifically described.

What is claimed is:

1. A side bearing assembly for a vehicle including a bolster and a car body disposed on the bolster, said side bearing assembly comprising:

a cage for attachment to the bolster of the vehicle;

a cap coupled to said cage and moveable relative to said cage for supporting a portion of the car body of the vehicle; and an insulator disposed between said cap and said cage for coupling said cap to said cage;

said insulator formed of microcellular polyurethane for resiliently deforming and storing energy during compressive movement between the car body and the bolster through a range of temperatures between −40° C. and 80° C.;

wherein said insulator includes an interior member extending along an axis and an exterior member including an inner surface defining a bore extending through said exterior member along said axis and receiving said interior member in said bore and wherein said interior member and said exterior member are formed of microcellular polyurethane.

2. The side bearing assembly as set forth in claim 1 wherein said insulator includes a bottom surface being planar and adjacent said cage and a top surface being planar and adjacent said cap.

3. The side bearing assembly as set forth in claim 2 wherein said insulator defines a hole through said bottom surface and through said top surface.

4. The side bearing assembly as set forth in claim 3 wherein said cage presents a base adjacent said bottom surface of said insulator and a cage protrusion extending from said base toward said insulator in engagement with said hole through said bottom surface of said insulator for maintaining the position of said insulator relative to said cage.

5. The side bearing assembly as set forth in claim 3 wherein said cap presents a plate adjacent said top surface of said insulator and a cap protrusion extending from said plate toward said insulator in engagement with said hole through said top surface of said insulator for maintaining the position of said insulator relative to said cap.

6. The side bearing assembly as set forth in claim 1 wherein said interior member presents an outer surface extending along said axis between said bottom surface and said top surface of said insulator and corresponding in shape to said inner surface of said exterior member and engaging said inner surface of said exterior member for maintaining said interior member in said bore of said exterior member.

7. The side bearing assembly as set forth in claim 6 wherein said outer surface of said interior member and said inner surface of said exterior member are frictionally engaged.

8. The side bearing assembly as set forth in claim 6 wherein said outer surface of said interior member is cylindrical and said inner surface of said exterior member is cylindrical.

9. The side bearing assembly as set forth in claim 1 wherein said exterior member includes a first section extending along said axis and a second section extending along said axis adjacent said first section.

10. The side bearing assembly as set forth in claim 1 wherein said cage includes a base and an inner wall extending from said base toward said cap.

11. The side bearing assembly as set forth in claim 10 wherein said cap includes a plate and an outer wall extending from said plate toward said cage and nesting with said inner wall of said cage for coupling said cap and said cage.

12. The side bearing assembly as set forth in claim 1 wherein said cage includes a flange defining a fastening orifice for receiving a fastener through said fastening orifice to fasten said cage to the bolster of the vehicle.

13. An insulator for disposition between a cage and a cap of a side bearing assembly of a vehicle, said insulator comprising:

an interior member presenting an outer surface extending along an axis; and an exterior member presenting an inner surface extending along said axis corresponding in shape with said outer surface of said interior member to define a bore through said exterior member with said outer surface of said interior member abutting said inner surface of said exterior member for maintaining said interior member in said bore;

said interior member and said exterior member formed of microcellular polyurethane for resiliently deforming and storing energy during compressive movement between the cage and the cap of the side bearing assembly through a range of temperatures between −40° C. and 80° C.

14. The insulator as set forth in claim 13 wherein said outer surface of said interior member and said inner surface of said exterior member are frictionally engaged.

15. The insulator as set forth in claim 13 wherein said outer surface of said interior member is cylindrical and said inner surface of said exterior member is cylindrical.

16. The insulator as set forth in claim 13 wherein said exterior member includes a first section extending along said axis and a second section extending along said axis adjacent said first section.

17. The insulator as set forth in claim 14 wherein both of said interior member and said exterior member present a bottom surface being planar for disposition adjacent said cage and a top surface being planar for disposition adjacent said cap.

18. The insulator as set forth in claim 13 wherein both of said interior member and said exterior member have a common density.

19. The insulator as set forth in claim 13 wherein said interior member has a first density and said exterior member has a second density different than said first density.

* * * * *